US006639561B2

(12) United States Patent
Pruss et al.

(10) Patent No.: US 6,639,561 B2
(45) Date of Patent: Oct. 28, 2003

(54) ANTENNA CONNECTOR

(75) Inventors: Felix Pruss, Tiberias (IL); Ruvim Goldman, Nazareth Illit (IL)

(73) Assignee: Galtronics Ltd., Phoenix, AZ (US)

( * ) Notice: Subject to any disclaimer, the term of this patent is extended or adjusted under 35 U.S.C. 154(b) by 0 days.

(21) Appl. No.: 09/801,273

(22) Filed: Mar. 7, 2001

(65) Prior Publication Data

US 2002/0101380 A1 Aug. 1, 2002

Related U.S. Application Data

(60) Provisional application No. 60/187,414, filed on Mar. 7, 2000.

(51) Int. Cl.[7] ..... H01Q 1/24
(52) U.S. Cl. ..... 343/702; 343/900
(58) Field of Search ..... 343/702, 901, 343/900, 715, 877, 903; 439/680, 578

(56) References Cited

U.S. PATENT DOCUMENTS 5,243,355 A 9/1993 Emmert et al. ..... 343/702
5,714,958 A * 2/1998 Rudisill ..... 343/702
6,002,372 A * 12/1999 Sullivan ..... 343/702
6,062,912 A * 5/2000 Witczak et al. ..... 439/680
6,064,341 A 5/2000 Hassemer ..... 343/702
6,215,446 B1 4/2001 Sullivan et al. ..... 343/702

FOREIGN PATENT DOCUMENTS

GB 2 327 153 1/1999

* cited by examiner

*Primary Examiner*—James Clinger
(74) *Attorney, Agent, or Firm*—Ladas & Parry

(57) ABSTRACT

A connection mechanism for snap-fitting an antenna into a hole in a receptacle, the receptacle typically being part of a 2-way mobile communication device. A latch, preferably mounted on a sleeve, including a stem and a latch head, extends around a circumference of the antenna. The latch is inwardly depressible to insert the antenna through the hole and is able to return to a non-depressed position to retain the antenna against the second end.

13 Claims, 5 Drawing Sheets

FIG. 3
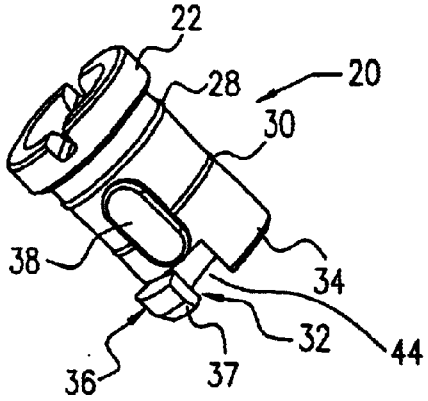
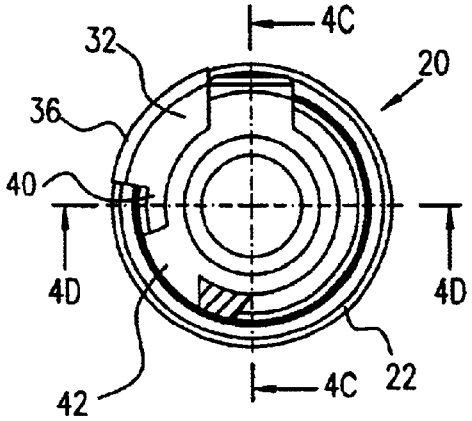
FIG. 4A
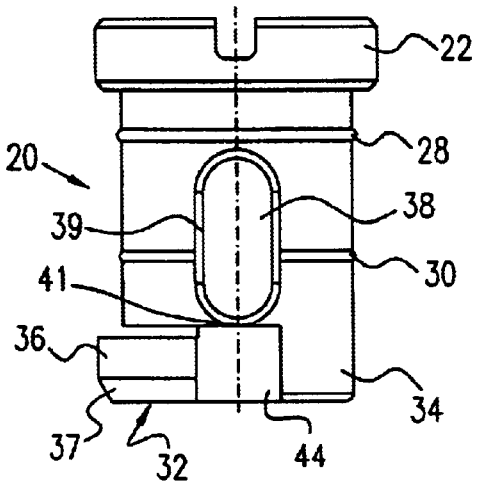
FIG. 4B
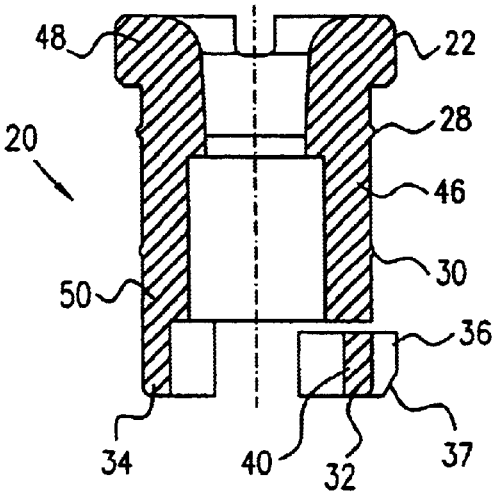
FIG. 4C
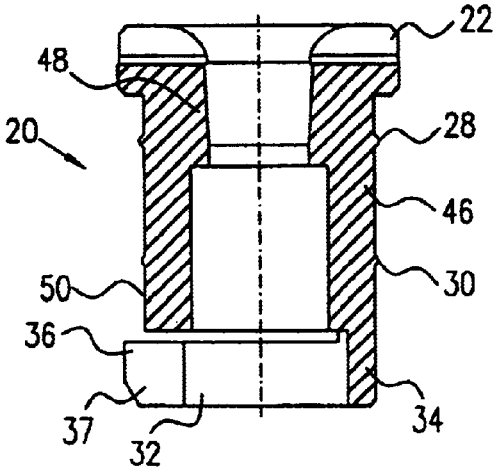
FIG. 4D

ANTENNA CONNECTOR

This application claims the benefit of Provisional application Ser. No. 60/187,414, filed Mar. 7, 2000.

FIELD OF THE INVENTION

The present invention relates to antenna connectors and more particularly but not exclusively to antenna connectors for snap-fitting into a casing.

BACKGROUND OF THE INVENTION

Devices that require antennas include one and two-way radios and mobile telephones. The devices include casings and generally require than an antenna is connected electrically through the casing to circuits inside and is also firmly attached mechanically to the casing such that the antenna cannot accidentally be removed due to longitudinal or shear forces. In addition it is desirable that intentional removal of the aerial be relatively easy.

A conventional mobile telephone and typical prior art antenna are shown in FIG. 2. A stubby antenna 2 has a snap-fit connection comprising a latch 4 at a lower end to enable it to be pressed into a casing 12 of a mobile telephone 10. The latch 4 comprises an arm 6 and a latch head 8. The arm 6 bends inwardly as the antenna 2 is pressed downwards through a hole in the casing 12 to allow the latch head 8 to pass therethrough. Due to the resilience of the arm 6 the latch head 8 springs outwardly on the far side of the hole to fix the antenna 2 in position.

A disadvantage of the antenna is that in order to remove the antenna without risk of breaking the latch, 4, it is necessary to remove the casing so that the latch 4 can be pressed inwards. Furthermore, if a sharp upward force is applied to the antenna 2 there is a strong risk of breaking the arm 6 and thus accidentally removing the antenna. The risk is increased because the arm 6 may in any case be weakened to make it flexible. If the arm 6 is broken it will be appreciated that the antenna 2 cannot be snapped back into place and the mobile phone may be returned by the customer for servicing.

SUMMARY OF THE INVENTION

In accordance with a first aspect of the present invention there is provided a connection mechanism for snap-fitting an antenna bushing extending along a first direction to a receptacle having an opening reaching from a first end to a second end, wherein a latch, including a stem and a latch head, extends around a circumference of the antenna bushing, in a plane substantially perpendicular to the first direction, which latch is inwardly depressible to a depressed position within the circumference to allow insertion of the antenna bushing into the opening from the first end and is able to return to a non-depressed position to retain the antenna bushing against the second end.

Preferably, the latch is mounted on a sleeve and further including a rib extending around the antenna bushing, the rib being located so as to underlie the latch when the sleeve is placed on the antenna bushing to abut against the rib.

Preferably, the rib is mounted on the antenna bushing.

Preferably, the sleeve is rotatable when latched to the receptacle to push the latch against a protrusion on the second end to depress the latch into the depressed position, thereby to extract the antenna bushing from the receptacle.

In one embodiment the connection mechanism may include an anti rotation device for preventing rotation of the sleeve when the antenna bushing with the sleeve placed thereon, is latched to the receptacle. Such an embodiment may require the case to be removed in order to allow the antenna bushing to be extracted.

Preferably, the anti-rotation device includes a protrusion on an outer surface of the sleeve adapted to fit within a corresponding groove in the receptacle.

According to a second aspect of the present invention there is provided an antenna bushing held in a first direction and connected to a 2-way transmitter device by a connection mechanism, the connection mechanism including a receptacle having an opening reaching from a first end to a second end, wherein a latch, including a stem and a latch head, extends around a circumference of the antenna bushing, in a plane substantially perpendicular to the first direction, which latch is inwardly depressible to a depressed position within the circumference to allow insertion of the antenna bushing into the opening from the first end and is able to return to a non-depressed position to retain the antenna bushing against the second end.

Preferably, the latch is mounted on a sleeve and further including a rib extending around the antenna bushing, the rib being located so as to underlie the latch when the sleeve is placed on the antenna bushing to abut against the rib.

Preferably, the rib is mounted on the antenna bushing.

Preferably, the sleeve is rotatable when latched in the receptacle to push the latch against a protrusion on the second end to depress the latch into the depressed position, thereby to extract the antenna bushing from the receptacle.

In an alternative embodiment, the connection mechanism includes an anti-rotation device for preventing rotation of the sleeve when the antenna bushing with the sleeve placed thereon, is latched to the receptacle.

Preferably, the anti-rotation device includes a protrusion on an outer surface of the sleeve adapted to fit within a corresponding groove in the receptacle.

According to a third aspect of the present invention there is provided a connector for latching an antenna holder to a housing, wherein the holder is adapted to hold an antenna to extend in a first direction, which connector is adapted to fit into the housing, wherein the holder fits into the connector and wherein the connector includes a circumferentially extending latch for latching the holder.

BRIEF DESCRIPTION OF THE DRAWINGS

For a better understanding of the invention and to show how the same may be carried into effect, reference is now made, purely by way of example, to the accompanying drawings, in which:

FIG. 3 is a simplified diagram showing a connector according to a first embodiment of the present invention;

FIG. 4A is a simplified diagram showing a view from below of the connector of FIG. 3;

FIG. 4B is a simplified diagram showing a side elevation of the connector of FIG. 3;

FIG. 4C is a simplified cutaway diagram of the connector of FIG. 3 along the line of an arrow 4C in FIG. 4A;

FIG. 4D is a simplified cutaway diagram of the connector of FIG. 3 along the line of an arrow 4D in FIG. 4A;

DESCRIPTION OF THE PREFERRED EMBODIMENTS

Figure 1:
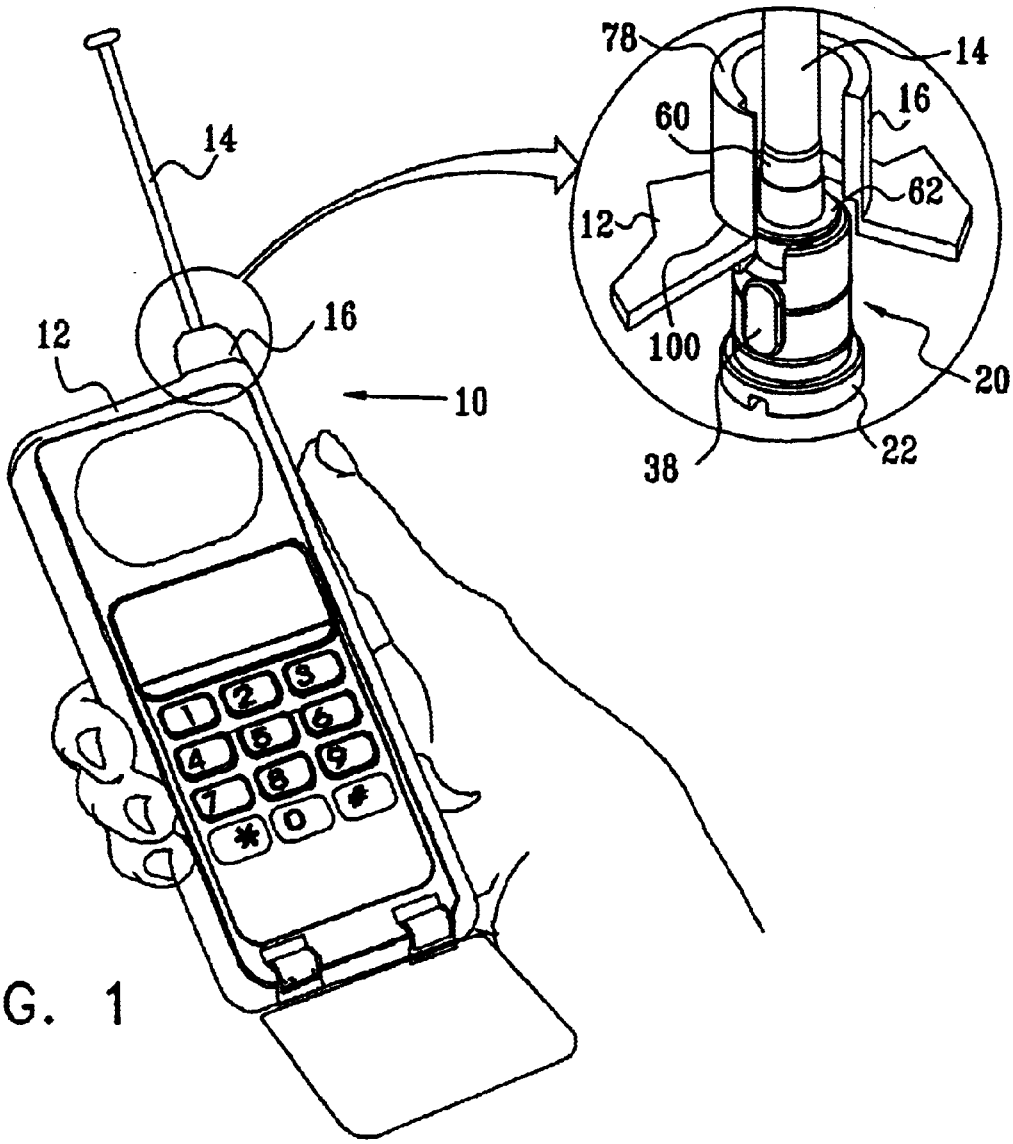
FIG. 1 is a simplified diagram showing a mobile telephone.

Reference is firstly made to FIG. 1 which is a simplified diagram showing a mobile telephone in accordance with a first embodiment of the present invention. In the embodiment of FIG. 1 a mobile phone 10 comprises an outer casing 12 through which is inserted an antenna 14. The antenna 14 has a receptacle 16 through which the antenna may be inserted via a connector 20, which is described hereinbelow with respect to FIG. 3. The connector 20 is able to snap into position in the receptacle 16 and serves to attach the antenna 14 firmly to the outer casing 12, preferably in such a way as to withstand unintended removal due to longitudinal or shear forces. As will be described below, in one embodiment, the connector is able to hold its place in the casing up to a given level of longitudinal force, and a variation of this embodiment frees itself if the given level is exceeded. In another embodiment the connector may be rotated using a key to disengage from the casing 12.

Figure 2:
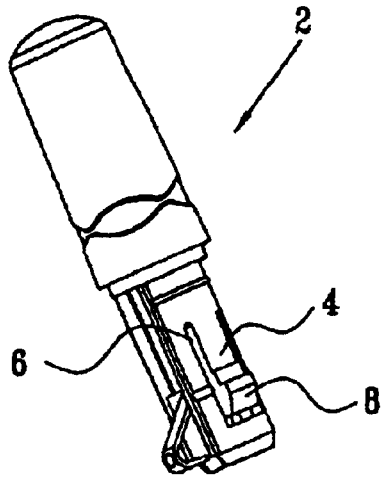
FIG. 2 PRIOR ART
FIG. 2 is a simplified diagram of a prior art snap-fit stubby antenna.

Reference is now made to FIG. 2, which is a simplified diagram of a prior art antenna. As described above, a stubby antenna 2 has a snap-fit connection comprising a latch 4 at a lower end to enable it to be pressed into a casing of a mobile telephone. The latch 4 comprises an arm 6 and a latch head 8. The arm 6 bends inwardly as the antenna is pressed downwards through the hole in a receptacle to allow the latch head 8 to pass through. Due to the resilience of the arm 6 the latch head 8 springs outwardly on the far side of the hole to fix the antenna 2 in position.

Reference is now made to FIG. 3 which is a simplified diagram showing a connector 20 constructed and operative in accordance with a first preferred embodiment of the present invention. The connector 20 is preferably of hollow cylinder construction within which the antenna 14 may be inserted using a pressure fit. An upper end 22 of the connector 20 comprises an outer lip extending around the circumference with facing ends thereof. The connector 20 also comprises two ribs, an upper rib 28 and a lower rib 30, which extend around the connector 20 at spaced intervals along the body of the connector 20. A part of a lower end 34 of the cylinder is cut away to form a tongue 32, which extends partially around the lower end 34 of the connector 20. The tongue 32 is joined to the lower end 34 of the connector 20 at one end 40 (FIG. 4A) and has a protrusion 36 at a second end, which protrudes outwardly of the connector 20. An outer lower surface 37 of the protrusion 36 is preferably chamfered to allow the protrusion 36 to be pushed inwards when pressed downwardly against another surface.

An anti-rotation protrusion 38 extends in the axial direction of the connector 20 along the outer face of the connector 20, preferably from just below the upper rib 28 to a cutaway portion 44 at the lower end 34, above the protrusion 36 of the tongue 32. The anti-rotation protrusion 38 preferably fits into a corresponding groove 61 in the receptacle 16, as will be described below, to prevent the connector 20 from being rotated.

Reference is now made to FIG. 4A, which is a simplified diagram showing a view from below, of the connector 20 of FIG. 3. Parts that are the same as those shown in previous figures are given the same reference numerals and are not described again, except as necessary for an understanding of the present embodiment. The tongue 32 comprises a stem 40, which connects the protrusion 36 to a base 42 of the connector 20. FIG. 4A illustrates that the protrusion 36 extends beyond the circumference of the base 42 and is aligned with the circumference of the outer lip of the upper end 22. It is appreciated that the stem 40 is typically resilient, allowing the protrusion 36 to be pushed inwardly to the circumference of the base 42 and to return to its original position when released.

Reference is now made to FIG. 4B, which is a simplified diagram showing a side elevation view of the connector 20 of FIG. 3. Parts that are the same as those shown in previous figures are given the same reference numerals and are not described again, except as necessary for an understanding of the present embodiment. The anti-rotation protrusion 38 has a first outer edge 39 that is aligned with the innermost edge of the tongue 32 and an inner edge 41 that is aligned with the edge of the cutaway portion 44 in the body of the connector 20, within which the tongue 32 is located.

Reference is now made to FIGS. 4C and 4D. FIG. 4C is a simplified cutaway diagram of the connector 20 viewed in the direction of arrows 4C (FIG. 4A). Parts that are the same as those shown in previous figures are given the same reference numerals and are not described again, except as necessary for an understanding of the present embodiment. As can be seen in FIG. 4C, the outer wall 46 of the connector 20 comprises an upper part 48 and a lower part 50. The upper part 48 is thicker and has an inner circumference which is smaller, that is to say extends inwardly to a greater extent, than an inner circumference of the lower part 50, which is thus thinner and more flexible. As will be explained below, the inner contour of the connector 20, comprising the upper part 48 and the lower part 50, is preferably sized to provide a pressure fit for an antenna bushing. The inner circumference of the tongue 32 extends inwardly of the inner circumference of the lower part 50 and is preferably aligned with the inner circumference of the upper part 48.

FIG. 4D is a simplified cutaway diagram of the connector 20 viewed in the direction of the arrows 4D (FIG. 4A). Parts that are the same as those shown in previous figures are given the same reference numerals and are not described again.

Figure 5:
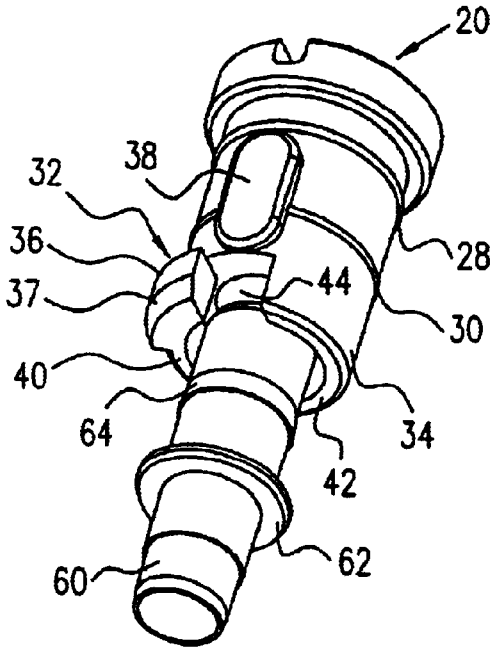
FIG. 5 is a simplified diagram showing how an antenna may be inserted into a connector according to the embodiment of FIG. 3.

Reference is now made to FIG. 5 which is a simplified diagram showing the method of inserting an antenna into a connector according to an embodiment of the present invention. In FIG. 5 parts that are the same as those shown in previous figures are given the same reference numerals and are not described again, except as necessary for an understanding of the present embodiment. A bushing 60 for an antenna comprises a locking rib 62 above which extends a slightly contoured surface 64. The contoured surface 64 is adapted to fit within the inner contour of the connector 20, as described above with respect to FIGS. 4C and 4D, to provide a pressure fit. The pressure fit need not be a tight pressure fit and in one preferred embodiment there is no pressure fit at all.

The bushing 60 preferably serves as both an electrical contact and a retainer for an antenna, typically a retractable antenna.

Figure 6:
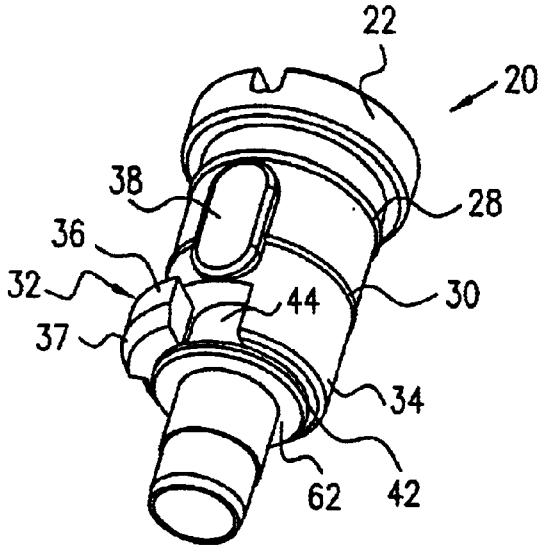
FIG. 6 is a simplified diagram showing an antenna bushing which has been inserted into a connector according to the embodiment of FIG. 3.

Reference is now made to FIG. 6 which is a simplified diagram showing an antenna bushing which has been inserted into the connector 20 according to the present invention. Parts that are the same as those shown in previous figures are given the same reference numerals and are not described again, except as necessary for an understanding of the present embodiment. The bushing 60 is inserted upwardly into the connector 20 until the locking rib 62 abuts against the base 42 of the connector 20. The pressure as described above ensures that the bushing 60 remains in place unless a sufficient force is exerted in the downward direction. In the upward direction the bushing 60 generally cannot be removed without breaking the rib 62.

An advantage of the rib 62 is that it serves as underlying support for the tongue 32. A sharp upward force on the antenna would tend to exert a lateral rotational force on the tongue 32 causing the stem 40 to snap. The rib 62, however, underlies the tongue 32, holding the protrusion 36 firmly in its horizontal orientation so that no rotational force is transferred to the stem 40. In fact, an upward force on the antenna 14 tends to drive the rib 62 upwardly against both the tongue and the base 42 of the connector 20 thereby spreading the pressure between the tongue 32 and the connector 20 and thus avoiding stressing the stem 40.

Figure 7:
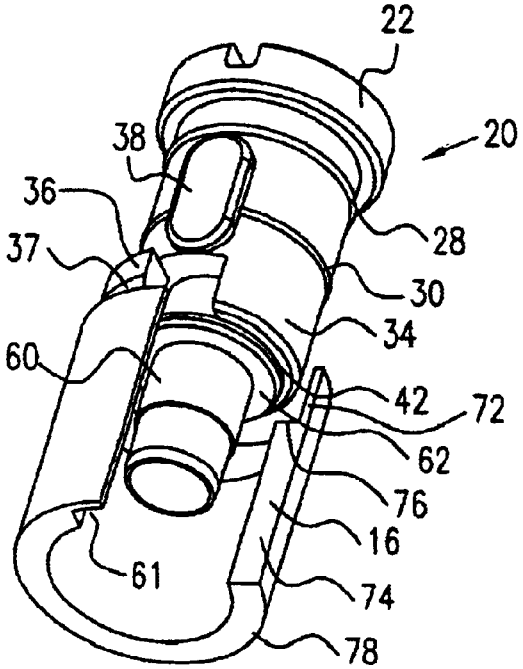
FIG. 7 is a simplified diagram showing how a connector, according to the embodiment of FIG. 3, with an antenna bushing may be inserted into a receptacle of a casing.
Figure 8:
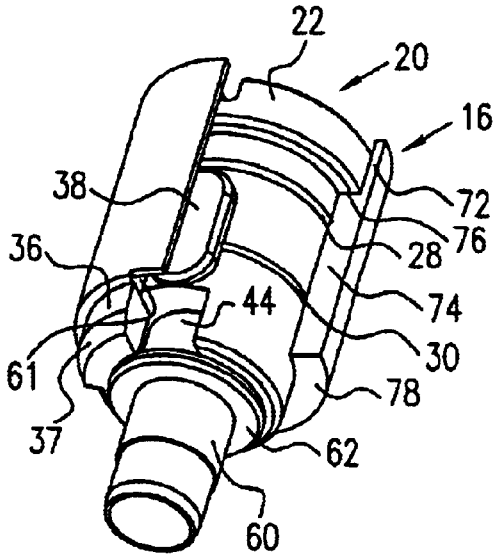
FIG. 8 is a simplified diagram showing a connector according to the embodiment of FIG. 3, with an antenna bushing, inserted into a receptacle of a casing.

Reference is now made to FIGS. 7 and 8, which are simplified diagrams showing how a connector according to the embodiment of FIG. 3, with an antenna bushing, may be inserted into a receptacle of a casing. Parts that are the same as those shown in previous figures are given the same reference numerals and are not described again, except as necessary for an understanding of the present embodiment. The receptacle 16, may be a part of the casing 12 of a mobile telephone 10 or other two-way radio devices, or alternatively it may be a separate unit mounted on the casing. The receptacle 16 is shown in cutaway form, and is preferably cylindrically shaped with a constant outer diameter. The receptacle 16 is comprised of two sections, an upper section 72 and a lower 74 section, or which the upper section 72 has a larger outer diameter, i.e. is thinner, than the lower section 74. Thus a shoulder 76 is formed therebetween.

Preferably, the outer diameters of the upper lip 22 and of the protrusion 36 of the tongue 32, are the same as the inner diameter of the upper section 72 of the receptacle body 16.

The outer diameter of the body of the connector 20 may be the same as the inner diameter of the lower section 74 of the receptacle body 16.

The ribs 28 and 30 preferably protrude beyond the inner diameter of the lower section 74 of the receptacle 16, and thus serve as crush ribs to provide a pressure fit. As well as holding the connector 20 more tightly to the receptacle 16, the pressure fit preferably also pushes the relatively thin outer wall of the lower section 50 against the antenna bushing 60, enhancing the fit of the antenna.

The axial length of the lower section 74 of the receptacle 16 is preferably the same as the axial length from the lower end of the lip 22 to the upper end of the protrusion 32, such that the connector 20 fits snugly into the receptacle 16, as shown in FIG. 8. However, even if this is not so, and the axial length of the lower section 74 of the connector 20 is shorter, the protrusion 32 may still effectively hold the connector 20 in place. In this case, the pressure it provided by the crush ribs 28 and 30 preferably serves to hold the connector 20 more stiffly in position. The anti-rotation protrusion 38 preferably fits into the corresponding groove 61 on the inner wall of receptacle 16 and prevents the connector 20 from being rotated.

As the connector 20 is pushed downwardly against the receptacle 16, the cutaway edge 37 of the protrusion 32 is pushed inwardly by the shoulder surface 76, allowing the lower part of the connector 20 to slide downwardly into the receptacle 16 until the lower edge of the lip 22 abuts against the shoulder surface 76. As it does so, the upper surface of the protrusion 32 reaches lower end 78 of the receptacle 16 and the protrusion 23 springs back outwardly to latch the connector 20 into the receptacle 16, as shown in FIG. 8.

The connector 20 is typically be made of plastic material, for example Zytol™ Delrin™ of polycarbonate.

In FIGS. 7 and 8, the lower section 74 of the receptacle 16, forming upper and lower shoulder edges 76 and 78, extend over a full circle. However, it is noted that the shoulder 76 is only required to extend over a limited angular sector along one side of the receptacle 16, as long as an aligning mechanism is provided to align the protrusion 32 against the shoulder 76. Such an alignment mechanism may for example utilize the anti-rotation protrusion 38 and the corresponding groove 61.

It is appreciated that the inner diameter of a hole 100 in the casing 12 aligns with the outer diameter of the shoulder 78 of the receptacle 16 (FIG. 1).

Figure 9:
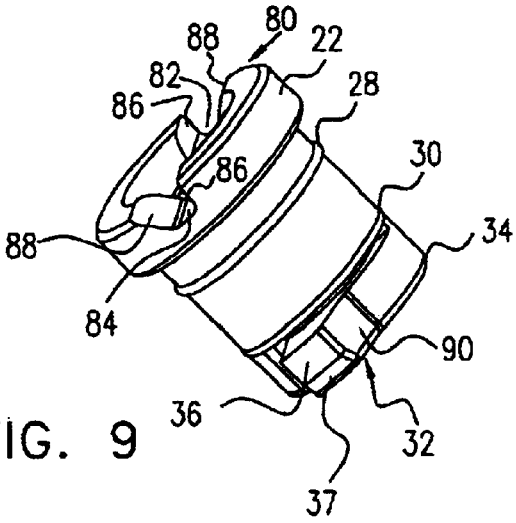
FIG. 9 is a simplified diagram showing a connector according to a second embodiment of the present invention.

Reference is now made to FIG. 9, which is a simplified diagram showing a second embodiment of the present invention. Parts that are the same as those shown in previous figures are given the same reference numerals and are not described again, except as necessary for an understanding of the present embodiment. The embodiment of FIG. 9 differs from the previous embodiment in that it is designed to be rotatable in one sense using a key so as to be easily removable. As shown in FIG. 9, a connector 80 has an upper end 22, which comprises an outer lip extending around the circumference. The lip is comprised with two slots 82 and 84 at facing ends thereof. Each of the slots 82 and 84 has one vertical fact 86 and one sloping face 88. Each vertical face 86 is facing in a counter-clockwise direction. The slots 82 and 94 thus allow an appropriately shaped key to be inserted for rotation of the connector 80 in the counter-clockwise sense. If the key, however, is turned in the clockwise sense, the sloping faces 88 cause the key to slip outwards and no rotation of the connector 80 occurs.

Protrusion 36 comprises keyed surface 37, as in the previous embodiment but in addition, one of the two circumferentially facing surfaces, denoted by reference numeral 90, faces the counterclockwise direction of rotation, is also keyed.

Figure 10A:
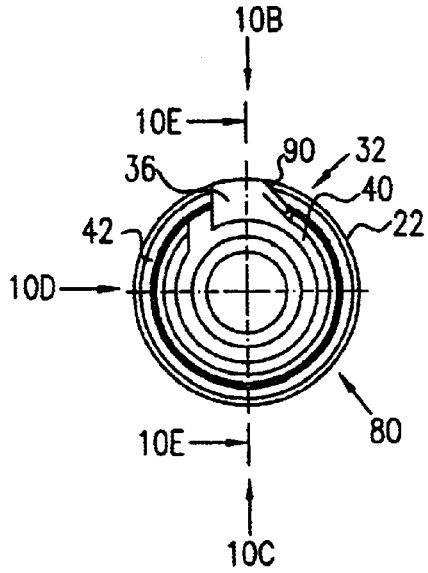
FIG. 10A is a simplified diagram showing a view from below, of the connector of FIG. 9.

Reference is not made to FIG. 10A, which is a simplified diagram showing a view from below, of the connector 80 of FIG. 9. Parts that are the same as those shown in previous figures are given the same reference numerals and are not described again, except as necessary for an understanding of the present embodiment. The tongue 32 comprises a stem 40 through which protrusion 36 is attached to base 42 of the connector 80. FIG. 10A illustrates how the protrusion 36 extends beyond the circumference of the base 42 and is preferably aligned with the circumference of the outer lip of the upper end 22. As will be appreciated, the stem 40 is resilient, allowing the protrusion 36 to act as a snap-in connection, in the same way as in the previous embodiment. The figure also illustrates the circumferentially facing keyed surface 90.

Figure 10B:
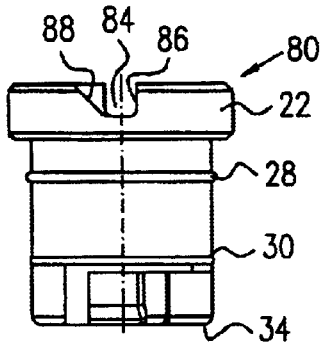
FIG. 10B is a simplified diagram showing a first side elevation of the connector of FIG. 9.
Figure 10C:
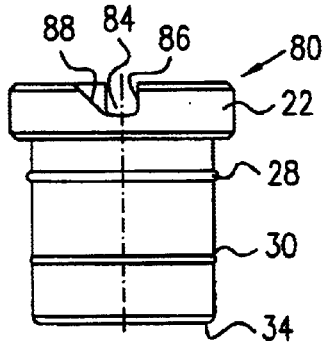
FIG. 10C is a simplified diagram showing a second side elevation of the connector of FIG. 9.
Figure 10D:
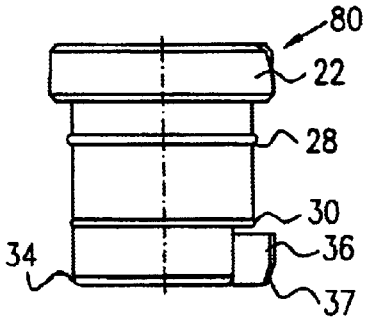
FIG. 10D is a simplified diagram showing a third side elevation of the connector of FIG. 9.

FIGS. 10B, 10C and 10D are simplified side elevations of the connector 80 of FIG. 9 taken respectively from directions indicated by the respective figure numbers of FIG. 10B.

Figure 10E:
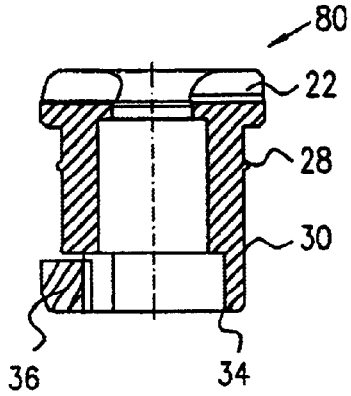
FIG. 10E is a simplified cutaway diagram of the connector of FIG. 9 along the line of an arrow 10E in FIG. 10A.

FIG. 10E is a simplified cross section along the line 10E in FIG. 10A of the connector 80 of FIG. 9. In all of these figures, parts that are the same as those shown in previous figures are given the same reference numerals and are not described again.

Figure 11:
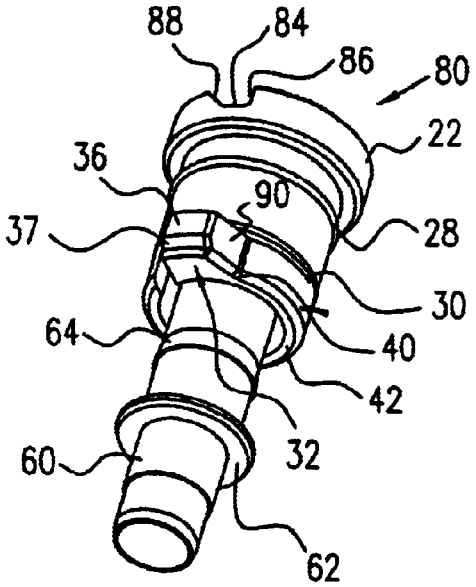
FIG. 11 is a simplified diagram showing how an antenna may be inserted into a connector according to the embodiment of FIG. 9.

Reference is now made to FIG. 11 which is simplified diagram showing how an antenna may be inserted into a connector according to the embodiment of FIG. 9. In FIG. 9, parts that are the same as those shown in previous figures are given the same reference numerals and are not described again, except as necessary for an understanding of the present embodiment. A bushing 60 for an antenna comprises a locking rib 62 above which extends a slightly contoured surface 64. The contoured surface 64 is adapted to fit within the inner contour of the connector 80, as described with respect to the embodiment of FIGS. 4C and 4D, to provide a pressure fit.

The bushing 60 serves as both an electrical contact and a retainer for an antenna, typically a retractable antenna. The bushing 60 preferably fits into the connector 80, as in the previous embodiment.

Figure 12:
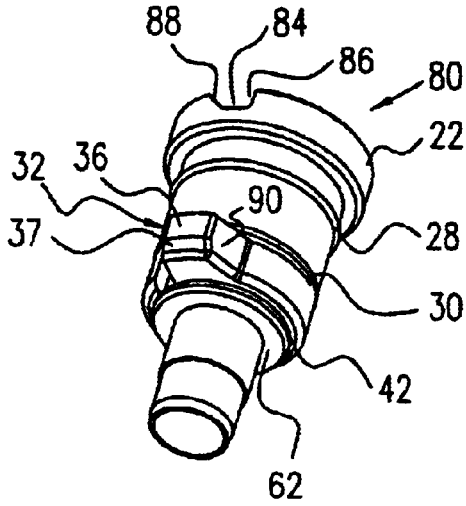
FIG. 12 is a simplified diagram showing an antenna bushing which has been inserted into a connector according to the embodiment of FIG. 9.

Reference is now made to FIG. 12 which is a simplified diagram showing an antenna bushing which has been inserted into a connector according to the embodiment of FIG. 9. Parts that are the same as those shown in previous figures are given the same reference numerals and are not described again, except as necessary for an understanding of the present embodiment. The bushing 60 is inserted upwardly into the connector 80 until the locking rib 62 abuts against the base 42 of the connector 80 as before. The pressure fit described above ensures that the bushing 60 remains in place unless a sufficient force is exerted in the downward direction. In the upward direction the bushing 60 generally cannot be removed without breaking the rib 62.

A further advantage of the rib 62 is that it serves as underlying support for the tongue 32. A sharp upward force on the antenna 14 would tend to exert a lateral rotational force on the tongue causing the stem 40 to snap. The rib 62 underlies the tongue 32, holding the protrusion 36 firmly in its horizontal orientation so that no rotational force is transferred in the stem 40. In fact an upward force on the antenna 14 tends to drive the rib 62 upwardly against both the tongue 32 and the base 42 of the connector 80 thereby spreading the pressure between the tongue 32 and the connector 80 and thus avoiding stressing the stem 40. On the other hand, a rotational force applied to the connector 80 is not affected by the presence of the rib 62.

Figure 13:
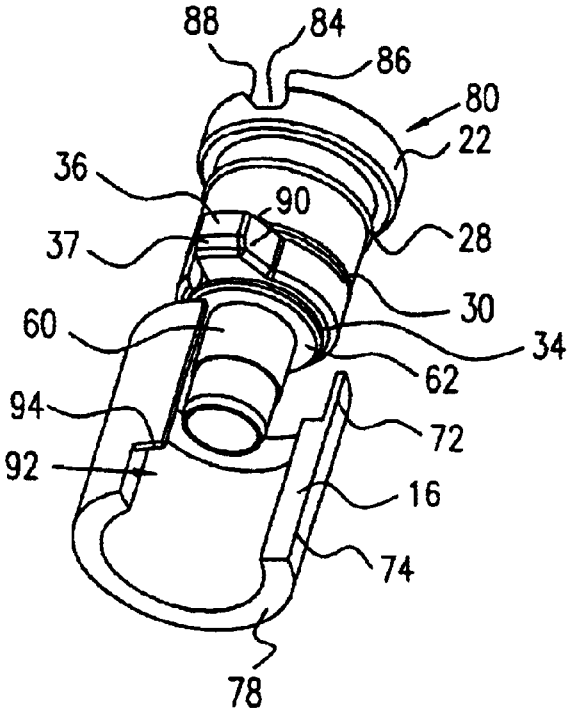
FIG. 13 is a simplified diagram showing how a connector according to the embodiment of FIG. 9 with an antenna bushing may be inserted into a receptacle of a casing.
Figure 14:
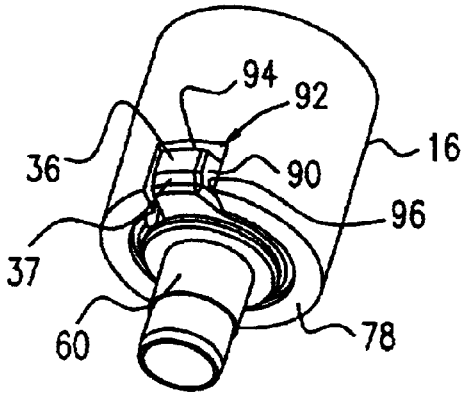
FIG. 14 is a simplified diagram showing a connector according to the embodiment of FIG. 9, with an antenna bushing, inserted into a receptacle of a casing.

Reference is now made to FIGS. 13 and 14, which are simplified diagrams showing how a connector according in the embodiment of FIG. 9 with an antenna bushing may be inserted into a receptacle of a casing. Parts that are the same as those shown in previous figures are given the same reference numerals and are not described again, except as necessary for an understanding of the present embodiment. The receptacle 16, may be a part of the casing 12 of a mobile telephone 10 or other two-way radio devices, or alternatively it may be a separate unit mounted on the casing 12, as shown in FIG. 1. The receptacle 16 is shown in cutaway form, and is preferably of cylindrical shape of constant outer diameter. It has two sections, and upper 72 and a lower 74 section, of which the upper section has a larger outer diameter, i.e. is thinner, than the lower section 74. Thus, a shoulder 76 is formed therebetween.

Preferably, the outer diameters of the upper lip 22 and of the protrusion 36 of the tongue 32, are substantially the same as the inner diameter of the upper section 72 of the receptacle 70.

The outer diameter of the body of the connector 80 may be the same as the inner diameter of the lower section 74 of the receptacle.

The ribs 28 and 30 preferably protrude beyond the inner diameter of the lower section 75 of the receptacle 70, and thus serve as crush ribs to provide a pressure fit. As well as holding the connector 80 more tightly to the receptacle 16, the pressure fit preferably also pushes the relatively thin outer wall of the lower section 50 against the antenna bushing 60, enhancing the fit of the antenna.

The axial length of the lower section 74 of the receptacle 16 is preferably longer than the axial length from the lower end of the lip 22 to the upper end of the protrusion 32, such that the protrusion 36 fits into a cutout 92 in the lower portion 74 of the receptacle 16. The pressure fit provided by the crush ribs 28 and 30 preferably serves to hold the connector more stiffly in position.

As the connector 80 is pushed downwardly against the receptacle 16, the keyed edge 37 of the protrusion 32 is pushed inwardly by the shoulder surface 76, allowing the lower part of the connector 80 to slide downwardly into the receptacle 16 until the lower edge of the lip 22 abuts against the shoulder surface 76. As it does so, the upper surface of the protrusion 32 reaches the upper end 94 of cutout 92 of the receptacle 16 and springs back outwardly to latch the connector 80 into the receptacle as shown in FIG. 14.

As the connector 80 is rotated in an anti-clockwise direction, the keyed face 90 is pushed downwards by an adjacent face 96 of the cutout 92, forcing protrusion 36 out of the cutout 92. Thus the connector is released from the receptacle 16 and may be removed.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention includes both combinations and subcombinations of the various features described hereinabove as well as variations and modifications thereof which would occur to persons skilled in the art upon reading the foregoing description and which are not in the prior art.

What is claimed is:

1. A connection mechanism for snap-fitting an antenna to a device along an insertion axis and comprising a latch, having a stem and a latch head, which stem lies generally in a plane which is substantially not parallel to said insertion axis.

2. A connection mechanism according to claim 1, wherein said latch is mounted on a sleeve and further comprising a rib extending around an antenna bushing, said antenna bushing extending along a first direction to a receptacle having an opening reaching from a first end to a second end, said rib being located so as to underlie said latch when said sleeve is placed on said antenna bushing to abut against said rib.

3. A connection mechanism according to claim 2, wherein said rib is mounted on said antenna bushing.

4. A connection mechanism according to claim 2, wherein said sleeve is rotatable when latched to said receptacle to push said latch against a protrusion on said second end to depress said latch into a depressed position, thereby to extract said antenna bushing from said receptacle.

5. A connection mechanism according to claim 4 further comprising an anti-rotation device for preventing rotation of said sleeve when said antenna bushing with said sleeve placed thereon, is latched to said receptacle.

6. A connection mechanism according to claim 5, wherein said anti-rotation device comprises a protrusion on an outer surface of said sleeve adapted to fit within a corresponding groove in said receptacle.

7. An antenna bushing held in a first direction and connected to a 2-way transmitter device by a connection mechanism, said connection mechanism comprising a latch, having a stem and a latch head, which stem lies generally in a plane which is substantially not parallel to an insertion axis.

8. An antenna bushing according to claim 7, wherein said latch is mounted on a sleeve and further comprising a rib extending around said antenna bushing, said rib being located so as to underlie said latch when said sleeve is placed on said antenna bushing to abut against said rib.

9. An antenna bushing according to claim 8, wherein said rib is mounted on said antenna bushing.

10. An antenna bushing according to claim 8, wherein said sleeve is rotatable when latched to a receptacle, having an opening reaching from a first end to a second end, to push said latch against a protrusion on said second end to depress said latch into a depressed position, thereby to extract said antenna bushing from said receptacle.

11. An antenna bushing according to claim 10, further comprising an anti-rotation device for preventing rotation of said sleeve when said antenna bushing with said sleeve placed thereon, is latched to said receptacle.

12. An antenna bushing according to claim 10, wherein said anti-rotation device comprises a protrusion on an outer surface of said sleeve adapted to fit within a corresponding groove in said receptacle.

13. A connector for latching an antenna holder to a housing, wherein said holder is adapted to hold an antenna to extend in a first direction, which connector is adapted to fit into said housing, wherein said holder fits into said connector and wherein said connector comprises a latch, having a stem and a latch head, which stem lies generally in a plane which is substantially not parallel to said insertion axis, for latching said holder.

* * * * *